United States Patent [19]

Simmons

[11] 4,425,697

[45] Jan. 17, 1984

[54] SPARK PLUG BOOT REMOVER

[76] Inventor: George Simmons, Rt. 2 Box 240, Buchanan, Tenn. 38222

[21] Appl. No.: 424,906

[22] Filed: Sep. 27, 1982

[51] Int. Cl.[3] ..... B25B 27/14

[52] U.S. Cl. ..... 29/280; 29/764

[58] Field of Search ..... 29/278, 280, 239, 764, 29/235; 81/3 R

[56] References Cited

U.S. PATENT DOCUMENTS

| | | | |
|---|---|---|---|
| 2,160,652 | 5/1939 | Feigh | 29/278 |
| 3,394,449 | 7/1968 | Black | 29/278 |
| 3,443,297 | 5/1969 | Lusby, Jr. . | |
| 3,835,522 | 9/1974 | Ward | 29/239 |
| 4,033,032 | 7/1977 | Romania et al. . | |
| 4,125,938 | 11/1978 | Clark . | |
| 4,202,088 | 5/1980 | Hansen . | |

*Primary Examiner*—Robert C. Watson
*Attorney, Agent, or Firm*—King and Liles

[57] ABSTRACT

A tool with a pair of longitudinally translatable components, includes a base with a lip to engage the underside of a boot covering a spark plug of an internal combustion engine. The other component, a slideable tongue, engages the engine head to provide a controlled reaction force against the underside of the boot to force it off the spark plug. The base of the tool may be fitted against the boot for aligning the tool to direct the reaction force in a direction substantially parallel to the longitudinal axis of the spark plug. The tool is activated after alignment by manually compressing a handle connected to the tongue to move toward a finger grip rigidly secured to the base. The tongue preferably is connected to the handle by an actuating rod guided by a sleeve mounted on the base.

9 Claims, 8 Drawing Figures

SPARK PLUG BOOT REMOVER

TECHNICAL FIELD

The invention relates generally to the removal of a spark plug wire from the terminal post of a spark plug. In particular, the invention relates to a tool for exerting a controlled pushing force against the underside of a spark plug boot to urge the boot off the plug.

BACKGROUND OF THE INVENTION

In a typical spark ignited internal combustion engine, a spark plug is threadably inserted into a threaded opening in the engine head to provide the spark in the engine combustion chamber. The spark plug has a threaded base for mounting, as described, and an elongated body portion, the body portion usually including an outer shell of an electrical insulating material, such as porcelain, the spaced electrodes extending from the bottom of the spark plug base project into the engine's combustion chamber. The spark plug is designed to develop a spark across the spaced electrodes to ignite the fuel/air mixture in the engine combustion chamber.

The elongated body of the spark plug extends outwardly from the engine head and terminates in an outboard terminal post. The outboard terminal post is electrically connected to the center electrode within the combustion chamber. A lead wire is connected to the outboard terminal post for the selective application of electrical current to effectuate a spark across the spaced electrodes disposed within the combustion chamber. The wire is typically housed in a boot or cover formed of a relatively soft flexible material such as rubber of plastic. The wire is connected to the outboard terminal post by a socket formed by a resiliently biased metal clip which compressively engages the post. The boot also extends over the body portion of the spark plug to partially cover the porcelain insulating material. The boot thus not only houses and protects the wire, it also protects the body of the spark plug from moisture, grease and other contaminants.

The need to protect the wire from physical damage has increased in recent years for several reasons. First, many modern spark plug wires are formed of carbon impregnated strands which are more susceptible to damage then conventional copper wiring. Further, in the case of modern automobile engines, it is common practice to house the engines in smaller and smaller areas and to place the spark plugs, and boots covering them, in relatively inaccessible areas within the engine compartment. Specifically, the spark plugs and boots are frequently disposed in relatively deep recesses of the engine head which are partially obstructed by a multitude of valve covers, hoses, cables, and other engine components and accessories. Consequently, mechanics working on the engines are often relegated to awkwardly grasping and squeezing the boot and the wires in an attempt to remove them. This stretches and distorts the wire and boot leading to a possible interruption in the efficient transmission of the electrical pulses to fire the spark plug. This in turn results in erratic engine performance. In extreme cases, the mechanic may attempt to use a pair of pliers for forcibly removing the boot from the spark plug. It is not uncommon to break or crack the porcelain portion of the plug in this instance, necessitating replacement even if not otherwise needed.

In order to ameliorate the problems noted above, several tools have been developed in recent years to remove boots from spark plugs. In U.S. Pat. No. 4,125,938, for example, a spark plug boot removing tool is disclosed with a pair of pivoted scissor-like levers used to engage the underside of a spark plug boot by squeezing the levers together in a scissor-like action. Once the scissor-like levers are squeezed together, oppositely disposed lips at the ends of the levers are brought into engagement with the underside of the boot, and the tool is pulled outwardly from the engine to thereby pull the boot off the spark plug.

Another tool for removal of spark plug boots is disclosed in U.S. Pat. No. 4,202,088. This latter mentioned tool is basicially an L-shaped hook with an insulated handle. The smaller of the L-shaped hook's legs has a semi-circular recess adapted for engagement with the underside of the spark plug boot. When the recess engages the underside of the boot, the tool is pulled away from the engine to force removal of the boot from the spark plug.

SUMMARY OF THE INVENTION

The invention advances the teachings of the prior art by providing a spark plug boot removal tool that pushes outwardly against the underside of a spark plug boot in a direction parallel to the longitudinal axis of the spark plug. The tool of the invention includes a semi-cylindrical base which fits about the peripheral side of the boot for alignment of the tool. A lip extends radially inward from the inner surface at one end of the semi-cylindrical base and engages the underside of the spark plug boot. A tongue slidingly fitted on the outer circumferential surface of the base is longitudinally extended thereon for selective engagement with the engine head. The reaction force from the tongue's engagement with the engine head is applied through the radially extending lip to push the boot away from the spark plug. Since the removal tool is aligned relative to the spark plug, the reaction force against the underside of the boot is similarly parallel to the spark plug's longitudinal axis.

The spark plug removal tool also includes a finger grip on the opposite longitudinal end of the base from the lip and a handle for reciprocally moving the tongue with respect to the base. The handle extends longitudinally beyond the finger grip and is adapted to be moved toward the finger grip by a manually applied compressive force. A resilient biasing force urges the handle away from the finger grip, which biasing force returns the tool to the initial position in readiness for the next removal operation.

A more specific aspect of the invention contemplates a guide sleeve on the outer surface of the base and an actuating rod connecting the handle and the tongue for reciprocally movable guided movement through the guide sleeve. This arrangement effectuates controlled longitudinal translation of the tongue relative to the base.

Accordingly, it is a primary object of the present invention to provide a tool for applying a controlled pushing force against the underside of a spark plug boot to remove the boot from a spark plug.

It is a further object of the invention to remove a boot from a spark plug through the application of a steady, guided force in a direction substantially parallel to the longitudinal axis of the spark plug.

BRIEF DESSCRIPTION OF THE DRAWINGS

The accompanying drawings incorporated in and forming a part of this specification, illustrate several aspects of the invention, and together with the description serve to explain the principles of the invention. In the drawings.

Figure 4:
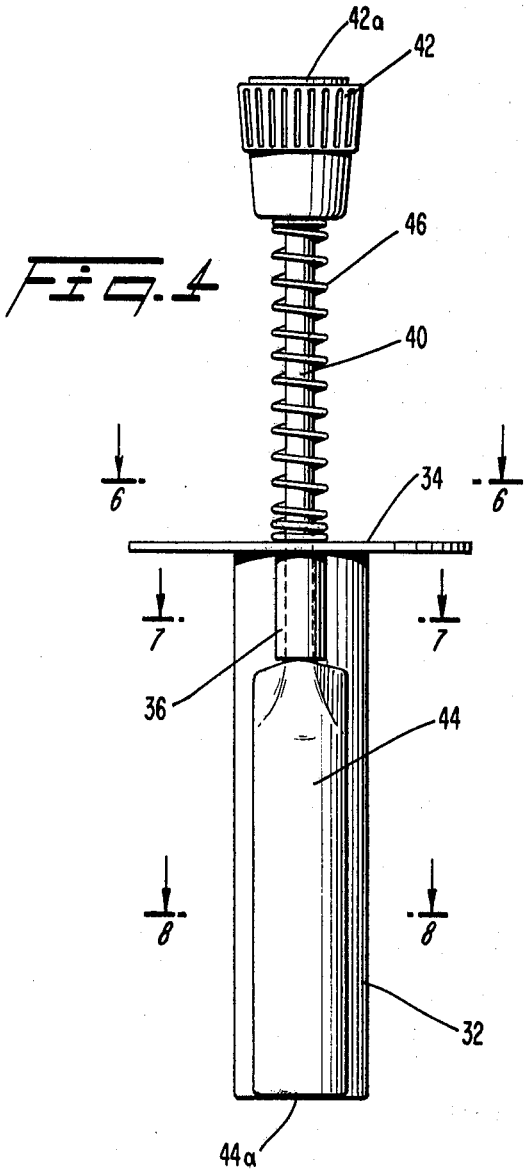
FIG. 4 is an enlarged front elevational view of the spark plug wire boot removal tool of FIGS. 1–3.
Figure 7:
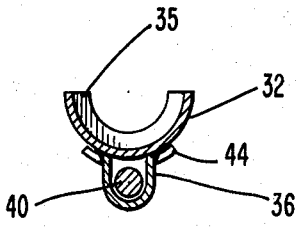
Figure 8:
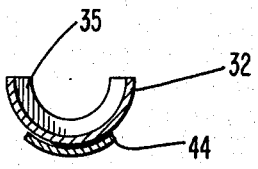

FIG. 7 is a sectional view taken along line 7—7 in FIG. 4 and depicting a relationship between the actuating rod and guide sleeve with the semi-circular tool body and also showing a semi-circular lip extending radially inward from the tool body; and FIG. 8 is a sectional view taken along the line 8—8 of FIG. 4 and depicting a relationship between the semi-circular body and the longitudinally translatable tongue.

Reference will now be made in detail to the present preferred embodiment of the invention, an example of which is illustrated in the accompanying drawings.

BEST MODE FOR CARRYING OUT THE INVENTION

Figure 1:
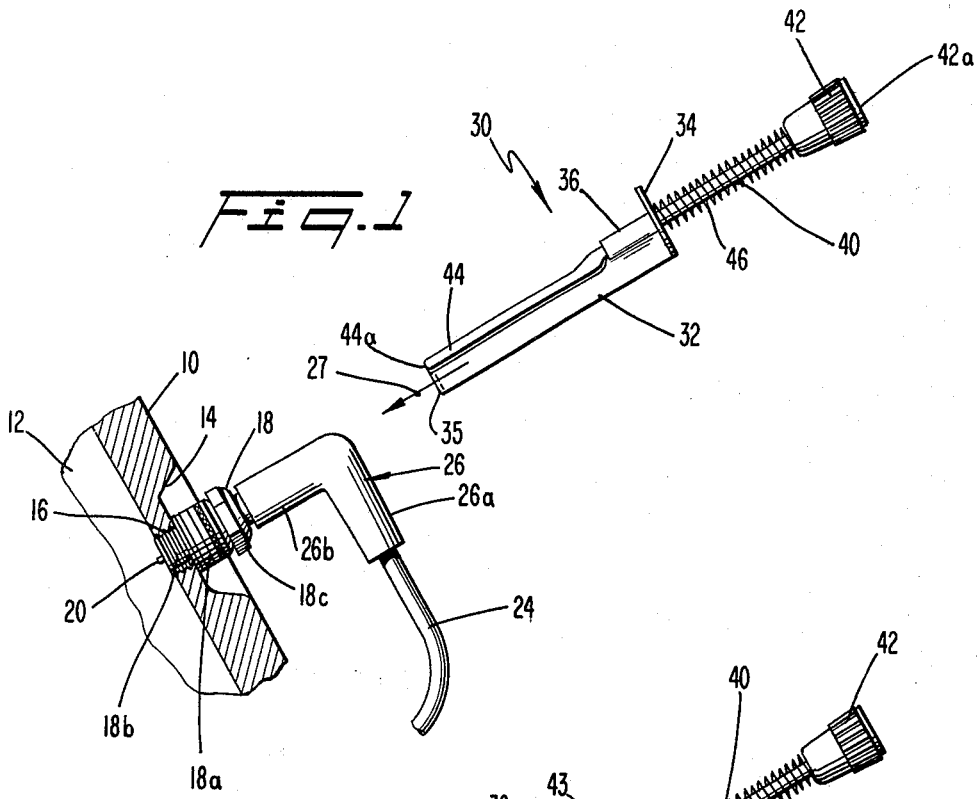
FIG. 1 is a fragmentary side elevational view, partially in cross section, of the head of an internal combustion engine having a spark plug extending into a combustion chamber with a spark plug boot inserted over the external end of the spark plug, and further depicting a spark plug wire boot removal tool in accordance with the present invention in proximity to the boot.

Referring now to the drawings, FIG. 1 depicts a head 10 of a spark ignited internal combustion engine. The head 10 encloses a combustion chamber 12 and includes a recess or well 14. A threaded opening 16 is centrally disposed within the well 14 leading to the combustion chamber 12. A spark plug 18 is threadably received by the opening 16. The spark plug 18 includes a base with two generally cylindrically shaped portions, a primary portion 18*a* and a threaded portion 18*b*, the latter portion being reduced with respect to the primary portion 18*a*. The primary portion 18*a* also includes a hexagonally shaped nut section 18*c*.

The spark plug 18 also includes a pair of spaced electrodes 20 (only the outermost of which is illustrated) partially disposed within the threaded portion 18*b*. When the threaded portion 18*b* is fully advanced into the opening 16, the spaced electrodes 20 are disposed within the combustion chamber 12. As is well known in the art, the spark plug 18 selectively generates a spark across the spaced electrodes 20 to ignite a fuel/air mixture within the combustion chamber 12.

The opposite end of the spark plug 18 includes a porcelain covered body 18*d* (see FIG. 3) with an outboard terminal post 22. As will be readily appreciated by those skilled in the art, the outboard terminal post 22 is in electrical contact with the center electrode through the body 18*d*. The outer electrode is grounded to the head 10.

Electrical wire 24 is connected to the outboard terminal post 22 by a socket (not shown) disposed within a boot or cover 26. This socket is formed in a manner well known in the art by a metal clip resiliently biased inwardly to compressingly engage the post 22 when the boot 26 is fully positioned over the spark plug body 18*d*.

The boot 26 is L-shaped in configuration and formed of a relatively soft flexible material such as rubber or plastic. One of the legs 26*a* of the L-shaped configuration houses the lead wire 24 while the other leg 26*b* forms a holllow sleeve into which the body 18*d* of the spark plug 18 is inserted. The boot leg 26*a* serves to house and protect the lead wire 24 from contaminants and physical damage and the leg 26*b* surrounds and protects the outboard terminal post 22 in the porcelain clad body 18*a* of the spark plug 18.

Spark plugs 18 and boot covers 26 such as described above are in widespread contemporary use with internal combustion engines. Unfortunately, these spark plugs 18 and boots 26 are not always readily accessible for removal and replacement. One example of a situation in which the spark plugs and boot covers are not readily accessible is in the engine compartment of a modern automobile. That is, these spark plugs 18 and boot covers 26 are positioned in relatively deep wells 14 in the head and obstructed from the outside by a plurality of other engine components and accessories. Furthermore, the boots 26 tend to stick to the outboard terminal post 22 and the porcelain clad spark plug body 18*a* on occasion, especially after boot 26 has been engaged to the spark plug 18 for an extended period of engine operation. As a result, mechanics who are removing the boot 26 for replacement of the spark plug 18 occasionally grip the wire 24 and boot 26 and pull and jerk relative to the spark plug. Removal of the boot 26 in this way tends to lead to physical damage of the lead wire 24. The risk of damage is particularly great when the lead wires 24 are carbon impregnated strands.

Figure 5:
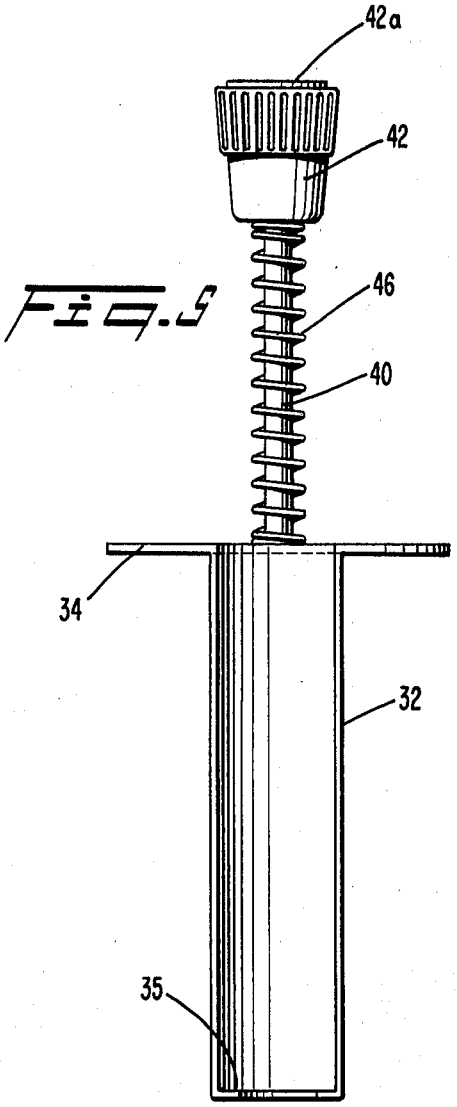
FIG. 5 is a rear elevational view of the spark plug wire removal tool of FIGS. 1–4.

A spark plug boot removal tool 30 is shown in FIG. 1 in close proximity to the boot 26 being advanced toward the boot 26, as indicated by arrow 27. The tool 30 includes an elongated base 32 of semi-cylindrical configuration with finger grips 34 disposed on one longitudinal end extending radially outward from the base 30. The opposite longitudinal end of the base 30, as perhaps best illustrated in FIGS. 5, 7 and 8, includes a radially inward extending lip 35 of semi-circular configuration. A hollow guide sleeve 36 of generally cylindrical configuration, best seen in FIGS. 4 and 7, is secured to the outer surface of the base 30 on the underside of the finger grips 34.

Figure 6:
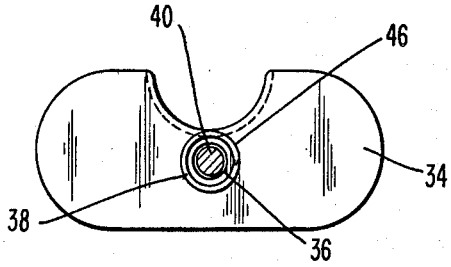
FIG. 6 is a sectional view taken along the line 6—6 in FIG. 5 and depicting a finger grip on the removal tool and its relationship to a reciprocally moving actuating rod and guide sleeve.

As seen in FIG. 6, finger grip 34 has an aperture 38 to receive and mount the sleeve 36. An elongated actuating rod 40 extends through the guide sleeve 36. A handle 42 is attached to one longitudinal end of the actuating rod 40 providing a pushing surface 42*a* for pushing the actuating rod 40 through guide sleeve 36. The opposite longitudinal end of the actuating rod 40 is secured to a semi-cylindrically shaped tongue 44. The tongue 44 has a radius of curvature approximating that of the base 32 and is in concentric relationship to the base 32, slidingly disposed on the base's exterior surface.

A compression spring 46 (see FIG. 4) is concentrically disposed about the actuating rod 40 between the handle 42 and finger grip 34. The handle 42, actuating rod 40 and tongue 44 are rigidly attached to each other and function as a single unit.

As illustrated, the tongue 44 is movable between two extreme positions relative to the base 32. The first is the withdrawn position depicted in FIGS. 1, 2, 4, and 5 in which the compression spring 46 has urged the handle 42 sufficiently upwardly so as to bring the tongue 44 into abutment with the guide sleeve 36. In this first position, the tongue 44 is preferably completely within the longitudinal limits of the base 32. In particular, the distal end 44*a* of the tongue preferably does not extend beyond the longitudinal terminus of the base 32.

Figure 3:
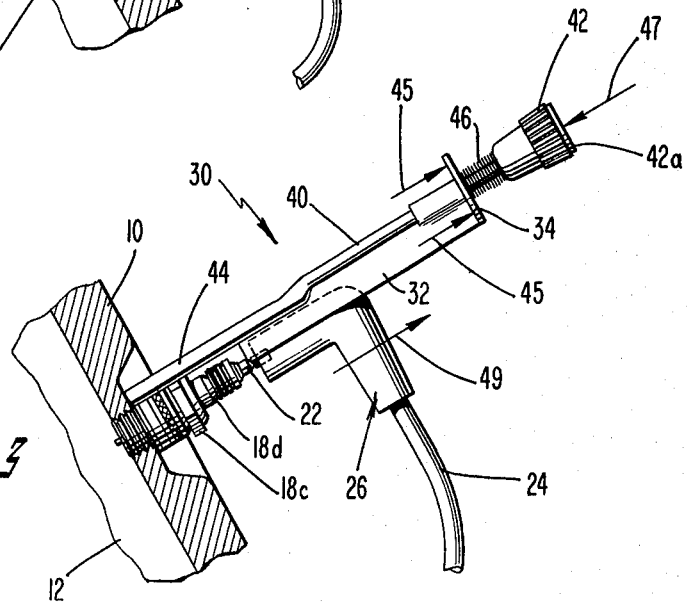
FIG. 3 is a fragmentary side elevational view similar to FIGS. 1 and 2 but showing a tongue of the removal tool longitudinally extended with respect to the tool base and engaged with the engine head to force the semi-circular lip at the end of the tool and the underside of the boot with which it is engaged away from the engine head.

The second extreme position of the tongue 44 relative to the base 32 is illustrated in FIG. 3. In the second position, the handle 42 is urged toward the finger grip 33 against the bias of spring 46. This movement of the handle 42 effectuates longitudinal extension of the tongue 44 relative to the base 32, extending the tongue end 44*a* into engagement with the head 10.

Figure 2:
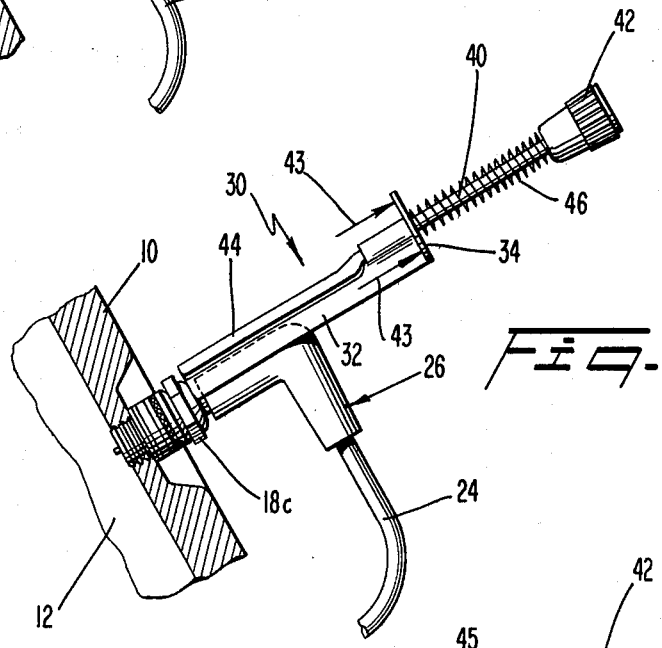
FIG. 2 is a fragmentary side elevational view, partially in cross section, similar to FIG. 1 but showing the spark plug wire boot removal tool guided into position and engaged with the boot by a semi-circular lip at the end of the tool.

The operation of the tool of the present invention is best illustrated through the comparison of FIGS. 1–3. FIG. 1 shows the tool 30 with the tongue 44 in its withdrawn position as the tool is being advanced toward the spark plug 18 and boot 26. The advancement of tool 30 toward the boot 26 is represented by arrow 27. In FIG. 2, the base 32 rests and is aligned against the outer surface of boot 26, and the radially inwardly extending lip 34 engages the underside of boot leg 26*b*. Since the leg 26*b* of boot 26 is generally cylindrical in configuration, the semicylindrical base 32 fits against the boot 26 exterior aligning the tool 30 in substantially parallel relationship to the longitudinal axis of the spark plug 18. The lip 34 is preferably initially seated into contacting relationship with the underside of boot 26 by a slight upward pulling force represented by arrow 43. FIG. 2 thus depicts the tool 30 after it has been applied to the boot 26 and aligned with respect thereto.

In FIG. 3, the tongue 44 is extended relative to the base 32. This movement is achieved by applying a compressive force between the handle 42 and the finger grip 33, as indicated by arrows 47 and 45. In its second or extended position, the tongue 44 extends substantially beyond the longitudinal terminus of base 32 and engages the engine head 10. Continued movement of the tongue 44 relative to the base 32 after the tongue engages the head 10, results in a reaction force against the underside of boot 26, as applied through the radially inwardly extending lip 35. This reaction force urges the boot 26 from the spark plug 18, as indicated by arrow 49 (FIG. 3).

It is significant that the reaction force applied by the lip 34 against the boot 26 is in a directional substantially parallel to the longitudinal axis of spark plug 18. Force applied in this direction is most likely to efficiently remove the boot 26 from the spark plug 18 without damaging the lead wire 24 contained within the boot 26. Also, the force applied against the boot 26 is a pushing force which is more controlled than the manual pulling forces of prior art tools.

In summary it is seen that numerous benefits may result from utilization of the invention. The invention permits the application of a pushing force against the underside of a spark plug boot 26 in a direction which is substantially parallel to the longitudinal axis of the spark plug 18. Thus, the boot 26 is not subjected to compressive or twisting forces prevalent with prior art tools for removing spark plug boots. The configuration of the tool of the invention also matches the exterior surface of the boot 26 and facilitates alignment with respect to the spark plug to apply the substantially parallel force. The force applied to the underside of the spark plug boot is a reaction force created by the relative longitudinal movement of two components of the tool. These two components are longitudinally translated by the application of a manually applied compressive force between a handle 42 and a finger grip 34 on the tool.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in the various embodiments and with various modifications as are suited to the particular use contemplated. It is intended that the scope of the invention be defined by the claims appended hereto.

I claim:

1. An apparatus for removing a spark plug wire boot from a spark plug mounted on an engine head or the like comprising:

(a) a longitudinally extending semi-cylindrical base, said base having a semi-circular lip extending radially inward from its interior surface at a first longitudinal end of the base, said semi-circular lip being adapted to engage the underside of a spark plug boot;

(b) a finger grip extending radially outward from the exterior surface of the base at the other longitudinal end;

(c) a tongue movably secured to said base for longitudinally translatable movement with respect thereto along the base's exterior surface, said tongue being movable from a first position in which the tongue is withdrawn and located along the base to a second position in which the distal end of the tongue extends into engagement with the head; and (d) handle means secured to said tongue for moving said tongue to the second position and force controlled movement of said base away from said head to thereby remove the boot by pushing engagement of the lip.

2. An apparatus as recited in claim 1 wherein the distal end of the tongue is entirely within the longitudinal limits of the base when the tongue is in its first position.

3. An apparatus as recited in claim 1 further including a guide sleeve secured to said base and an actuating rod secured to said tongue at one end, said actuating rod being disposed within said sleeve for guided reciprocal movement with respect to said base.

4. An apparatus as recited in claim 3 further including a handle secured to the opposite end of the actuating rod, said handle including a pushing surface for manually urging the handle relative to the finger grip and said tongue toward said second position.

5. An apparatus as recited in claim 1 wherein is included a compression spring circumferentially disposed about said actuating rod between said finger grip and said handle to withdraw said tongue from the second position.

6. An apparatus as recited in claim 1 wherein said tongue has an arcuate configuration and is disposed in concentric relationship to said base for guiding action.

7. An apparatus as recited in claim 3 wherein said guide sleeve is positioned adjacent said finger grip.

8. An apparatus as recited in claim 1 wherein the finger grip extends radially outward from the base on opposite sides.

9. An apparatus as recited in claim 6 wherein said tongue has a radius of curvature approximately the radius of curvature of the base.

* * * * *